US008869715B2

(12) United States Patent
Hoffman

(10) Patent No.: US 8,869,715 B2
(45) Date of Patent: Oct. 28, 2014

(54) TILTING TABLETOP MECHANISM

(71) Applicant: Jeremy Hoffman, Birdseye, IN (US)

(72) Inventor: Jeremy Hoffman, Birdseye, IN (US)

(73) Assignee: Ditto Sales, Inc., Jasper, IN (US)

( * ) Notice: Subject to any disclaimer, the term of this patent is extended or adjusted under 35 U.S.C. 154(b) by 17 days.

(21) Appl. No.: 13/663,703

(22) Filed: Oct. 30, 2012

(65) Prior Publication Data

US 2013/0061782 A1 Mar. 14, 2013

Related U.S. Application Data

(63) Continuation of application No. 12/481,524, filed on Jun. 9, 2009, now Pat. No. 8,297,208.

(51) Int. Cl.

| | |
|---|---|
| ***A47B 3/00*** | (2006.01) |
| ***A47B 13/08*** | (2006.01) |
| ***A47B 7/02*** | (2006.01) |
| ***E05D 11/10*** | (2006.01) |

(52) U.S. Cl.

CPC . *A47B 13/08* (2013.01); *A47B 7/02* (2013.01); *E05D 11/1028* (2013.01); *E05Y 2900/20* (2013.01)

USPC ..... 108/133

(58) Field of Classification Search

USPC ..... 108/115, 121–124, 127–135, 168, 172, 108/1–10

See application file for complete search history.

(56) References Cited

U.S. PATENT DOCUMENTS

| | | | | |
|---|---|---|---|---|
| 4,986,195 | A * | 1/1991 | Diffrient | 108/150 |
| 5,131,333 | A * | 7/1992 | Karasawa et al. | 108/7 |
| 5,354,027 | A * | 10/1994 | Cox | 248/292.14 |
| 6,394,005 | B1 * | 5/2002 | Isensee et al. | 108/132 |
| 6,845,723 | B2 * | 1/2005 | Kottman et al. | 108/132 |
| 7,509,914 | B2 * | 3/2009 | Murphy | 108/133 |
| 7,677,184 | B2 * | 3/2010 | Dhanoa et al. | 108/115 |
| 7,703,400 | B2 * | 4/2010 | Mockel | 108/115 |
| 2008/0178778 | A1 * | 7/2008 | Koning et al. | 108/132 |
| 2009/0283020 | A1 * | 11/2009 | Hsu | 108/115 |
| 2010/0258042 | A1 * | 10/2010 | Rutz | 108/115 |

* cited by examiner

*Primary Examiner* — Darnell Jayne
*Assistant Examiner* — Timothy M Ayres
(74) *Attorney, Agent, or Firm* — Maginot, Moore & Beck, LLP

(57) ABSTRACT

An article of furniture has been developed having a tilting tabletop mechanism, which securely maintains a tabletop in either a generally horizontal or generally vertical position while permitting a user to tilt the tabletop easily. The article of furniture includes a first component, a second component, a first member, a second member, a first lock element, and a second lock element. The second component is pivotally coupled to the first component. The first and second members are connectable to a first secured component. The first secured component is one of the first and second components. The first lock element is mounted to engage the first member when the first component is in a first position relative to the second component. The second lock element is mounted to engage the second member when the first component is in a second position relative to the second component.

8 Claims, 9 Drawing Sheets

TILTING TABLETOP MECHANISM

CLAIM OF PRIORITY

This application claims priority to previously filed U.S. application Ser. No. 12/481,524, entitled "Tilting Tabletop Mechanism", which was filed on Jun. 9, 2009, the disclosure of which is incorporated herein by reference.

BACKGROUND

The present invention relates generally to the field of tables and in particular to tables having a tiltable tabletop.

Traditional tables include a tabletop that is fixed to a support frame. When a traditional table is oriented in an upright position, the tabletop provides an area for performing various tasks, as is known in the art. In order to store a traditional table in the upright position, a floor space is needed that is approximately equal to the surface area of the tabletop. To store a traditional table in a smaller floor space, some tables can be lifted and rotated to a lateral position in which a side edge of the tabletop is placed on the floor. In this lateral position, storage of the table may require less floor space as compared to the upright position; however, it can be difficult for some users to lift and rotate a traditional table. Furthermore, the support frame of a traditional table may undesirably protrude from the tabletop in an inconvenient manner. To address this problem, the support frame of some traditional tables may be disassembled from the tabletop. Even though storing a disassembled traditional table may require less floor space than storing a traditional table oriented in the upright or lateral positions, the disassembly process is often overly time consuming and cumbersome. Additionally, before the table can be used again, it must be reassembled. Therefore, while traditional tables work well for most users, some users may prefer a table that can be stored in a relatively compact configuration, but that can also be easily and quickly returned to a usable configuration.

To meet this need, a table referred to as a "tiltable table" has been developed. Tiltable tables include a tabletop that is pivotally coupled to a ground engaging support frame. In particular, the tabletop is often pivotable between a generally horizontal position and a generally vertical position. In the horizontal position, tiltable tables function like traditional tables. In the vertical position, however, tiltable tables can be more easily stored than traditional tables. Specifically, when the tabletop of a tiltable table is pivoted to the vertical position, the tiltable table utilizes a floor space approximately equal to the floor space utilized by the support frame, which is generally much less than the floor space required to store a traditional table oriented in the upright position. When use of the tiltable table is again desired, the tabletop can be pivoted to the horizontal position. Accordingly, tiltable tables provide users with a table that utilizes less floor space in storage than a traditional table, and is easily reconfigured to function as a traditional table.

Known tiltable tables suffer from several deficiencies, the most blatant of which being a lack of stability. Specifically, known tiltable table mechanisms often inadequately secure the tabletop in the horizontal position. Additionally, the tilting mechanism of known tiltable tables may be complicated to operate. For instance, in order to tilt a tabletop between the horizontal and vertical positions a user may have to move multiple levers and releases in a complicated sequence before the tabletop may be tilted. Therefore, further developments in the area of tiltable tables are desirable.

SUMMARY

An article of furniture has been developed having a tilting tabletop mechanism, which securely maintains a tabletop in either a generally horizontal or generally vertical position while permitting a user to tilt the tabletop easily. The article of furniture includes a first component, a second component, a first member, a second member, a first lock element, and a second lock element. The second component is pivotally coupled to the first component. The first member is connectable to a first secured component. The first secured component is one of the first and second components. The second member is also connectable to the first secured component. The first lock element is mounted to engage the first member when the first component is in a first position relative to the second component. The second lock element is mounted to engage the second member when the first component is in a second position relative to the second component.

A mechanism has also been developed for positioning a component of an article of furniture. The mechanism includes a first member, a second member, a first lock element, and a second lock element. The first member is connected to a first component and is connectable to a second component. The second member is connected to the first component and is connectable to the second component. The first lock element is connected to the second component and is mounted to engage the first member when the second component is in a first position relative to the first component. The second lock element is connected to the second component and is mounted to engage the second member when the second component is in a second position relative to the first component.

BRIEF DESCRIPTION OF THE FIGURES

The foregoing aspects and other features of the present disclosure are explained in the following description, taken in connection with the accompanying figures.

DETAILED DESCRIPTION

Figure 1:
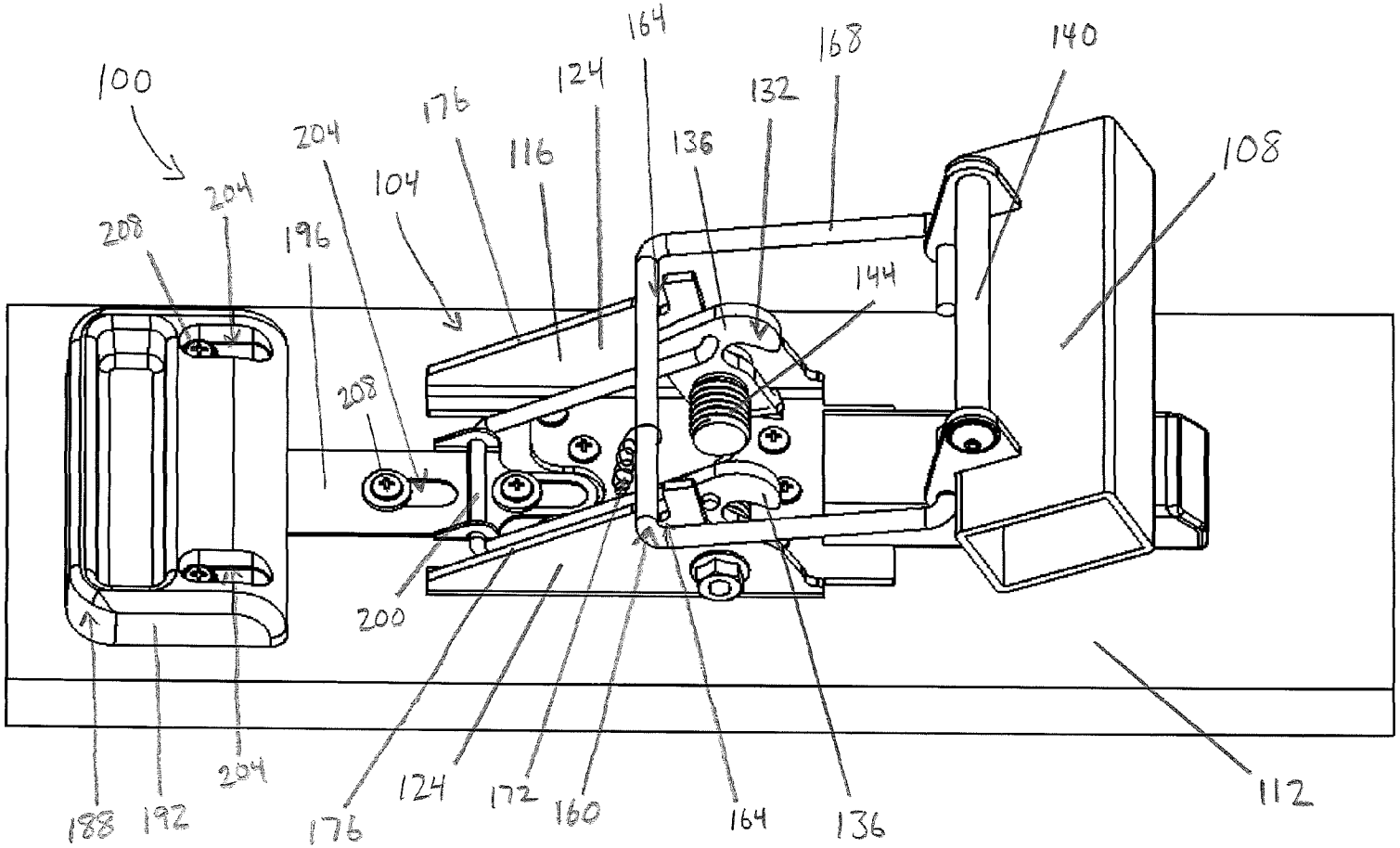
FIG. 1 is a perspective view of one embodiment of a tabletop tilting mechanism shown in a vertical position.
Figure 2:
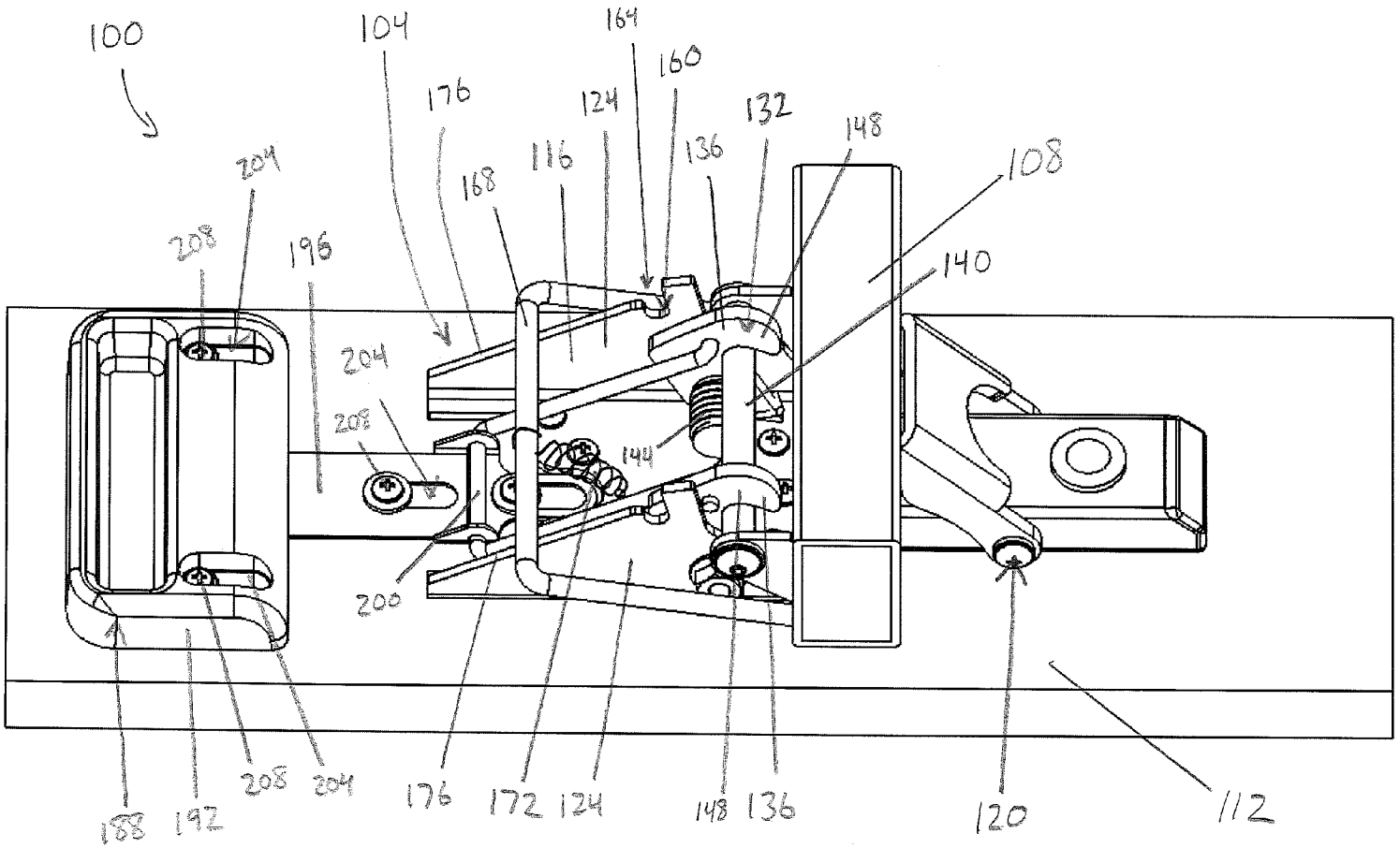
FIG. 2 is a perspective view of the tabletop tilting mechanism of FIG. 1 shown in a horizontal position.
Figure 3:
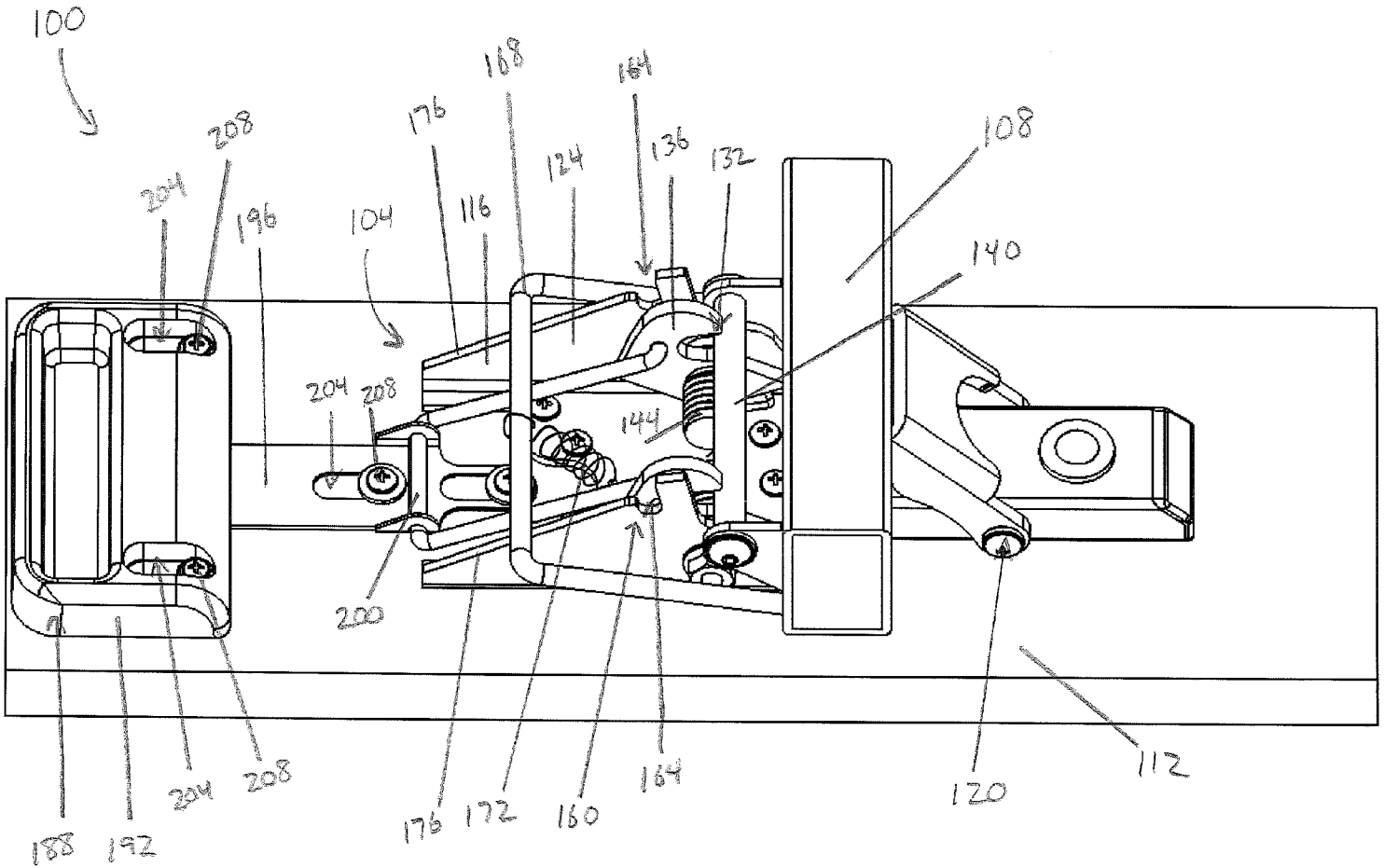
FIG. 3 is a perspective view of the tabletop titling mechanism of FIG. 1 shown in an intermediary position.

One embodiment of a tiltable table 100 having a tilting tabletop mechanism 104 is illustrated in FIGS. 1-3. The tabletop mechanism 104 secures one of a first and second components in one of two positions relative the other of the first and second components. One of the first and second components may be provided as a support frame 108, and the other of the first and second components may be provided as a tabletop 112. The tabletop mechanism 104 includes a bracket member 116, a first and second lock element, and an actuator 188. The bracket 116 supports, among other components, the first and second lock element. The first lock element may secure the tabletop 112 in a horizontal working position, referred to as a horizontal position. Whereas, the second lock element may secure the tabletop 112 in a vertical storage position, referred to as a vertical position. The actuator 188 disengages the lock elements to permit the tabletop 112 to be pivoted between the horizontal and vertical positions. Below each component of a tiltable table 100 having a tabletop mechanism 104 is described in detail.

The tabletop 112 is pivotally coupled to the support frame 108 at pivot point 120 for movement between the horizontal and vertical positions. The tabletop 112 may be of any known construction. Furthermore, the tabletop 112 may define more than one planar surface. For instance, the tabletop 112 may include a working portion and a skirt portion (not illustrated). The working portion may define a generally horizontal plane when the tabletop mechanism 104 is in the horizontal position. The skirt portion, however, may be coupled to an edge of the working portion to define a plane that is approximately perpendicular to the horizontal plane defined by the working portion. When the tabletop 112 is pivoted between the horizontal and vertical positions, both portions of the tabletop 112 are pivoted.

The support frame 108 of the tabletop mechanism 104 rigidly supports the tabletop 112 in both the horizontal and vertical positions. Additionally, the support frame 108 remains stable as the tabletop 112 is transitioned between the horizontal and vertical positions. The support frame 108, and each other component of the tabletop mechanism 104, may be constructed from rigid materials including, but not limited to, plastic, steel, and other metals. It is noted that only a portion of the support frame 108 is illustrated in FIGS. 1-3. In particular, the illustrated portion is a component of the support frame 108 that is generally parallel to the floor. Table legs (not illustrated) may be coupled to the illustrated support frame 108 component to support the tabletop 112 as is known in the art.

As mentioned above, the tabletop mechanism 104 permits the tabletop 112 to be secured in two positions relative the support frame 108. Often, one position secures the tabletop 112 in a generally horizontal orientation and the other position secures the tabletop 112 in a generally vertical orientation. In other embodiments, however, the mechanism 104 may secure the tabletop 112 in an inclined position and a vertical position. For instance, in the inclined position the mechanism 104 may secure the tabletop 112 at an approximately forty-five degree angle relative a plane parallel to the floor, as is commonly done with drafting tables and the like. For simplicity, the mechanism 104 is described herein as securing a tabletop 112 in a horizontal and a vertical position; although, it is understood that the mechanism 104 may secure the tabletop 112 in two positions of an angular orientation. It is noted that the tabletop mechanism 104 is shown secured to the bottom surface of the tabletop 112 in FIGS. 1-3.

Figure 4:
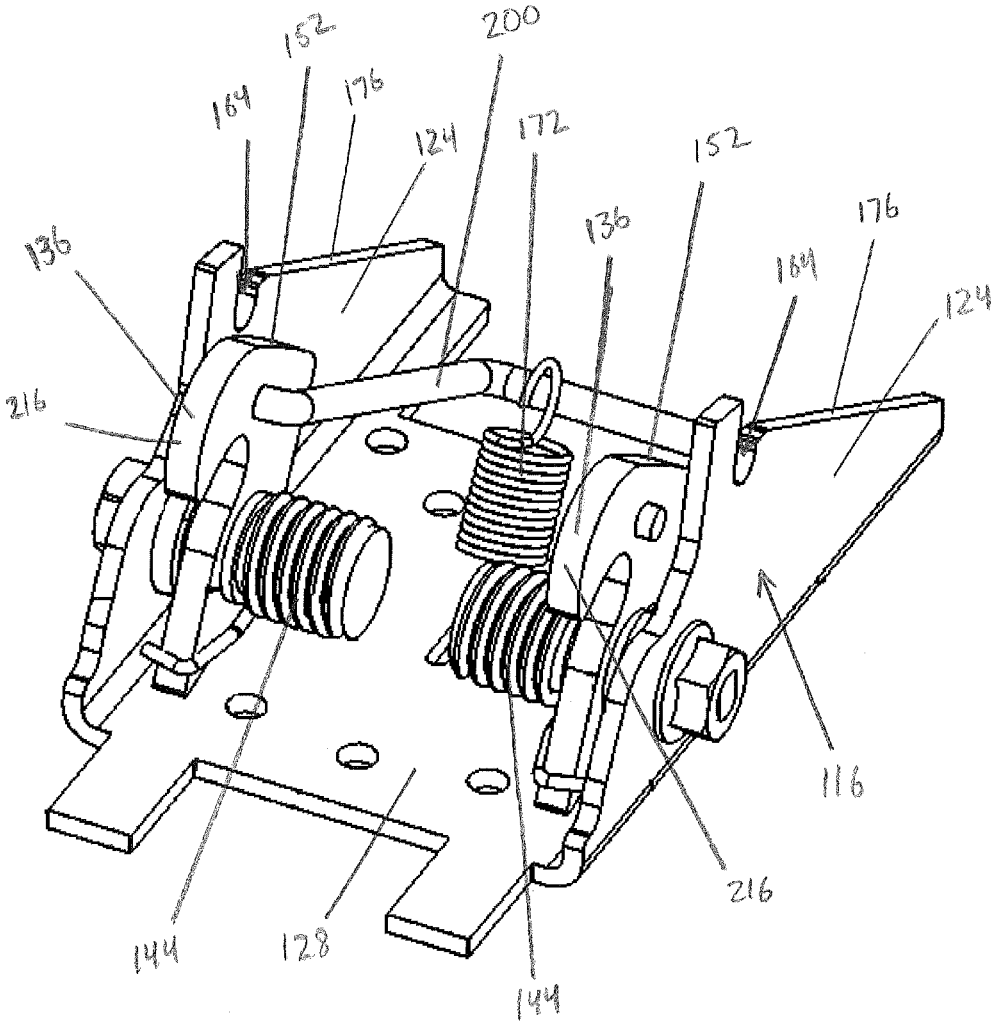
FIG. 4 is a perspective view of a bracket assembly of the tabletop tilting mechanism of FIG. 1 showing the pivot members and biasing springs.
Figure 5:
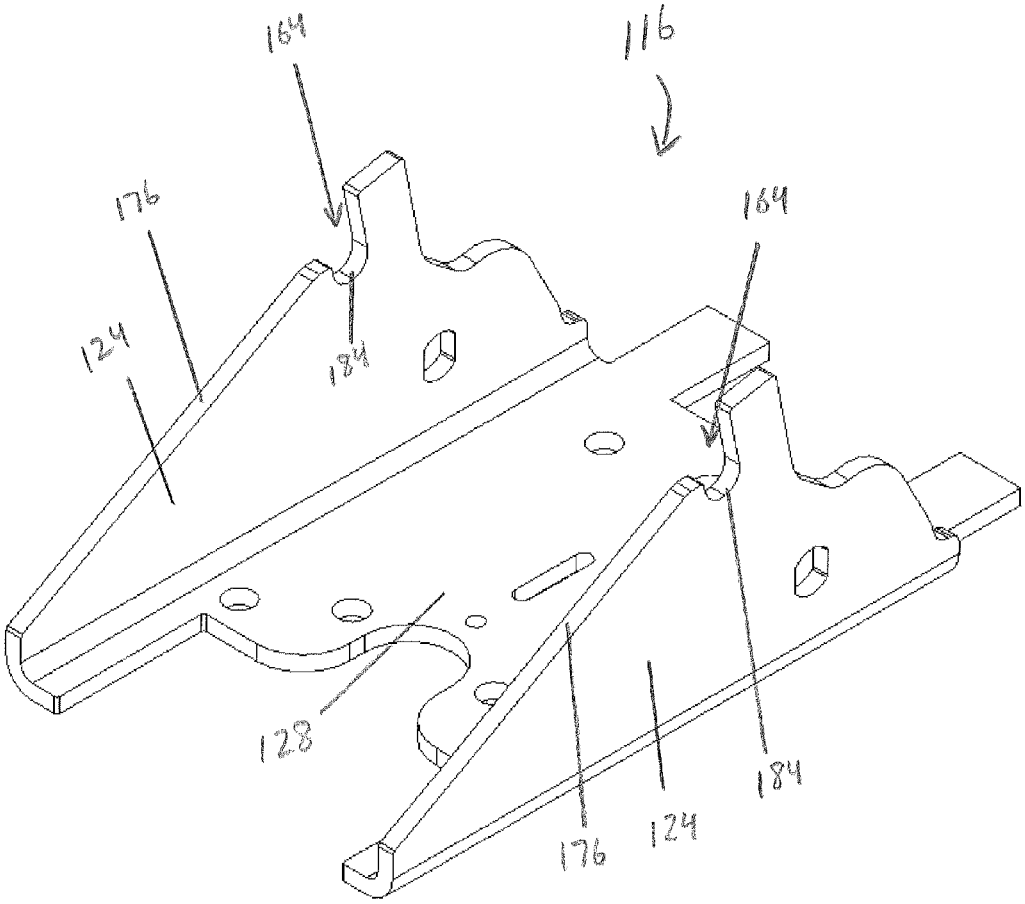
FIG. 5 is a perspective view of the bracket assembly of the tabletop tilting mechanism of FIG. 1.
Figure 7:
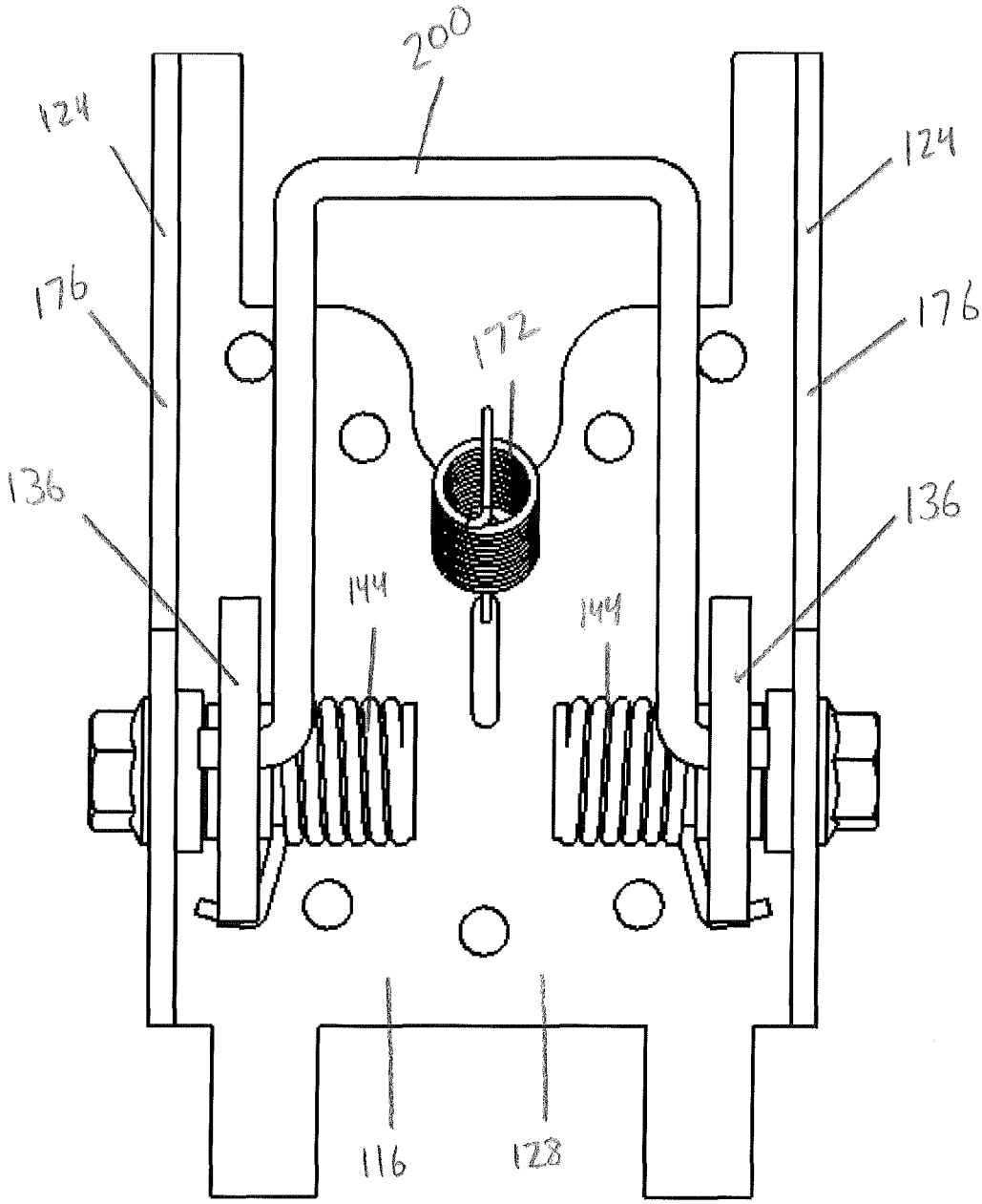
FIG. 7 is top plan view of the bracket assembly of the tabletop tilting mechanism of FIG. 1.

The bracket 116 may be connected to the tabletop 112 as shown in FIGS. 1-3. However, in other embodiments the bracket 116 may be connected to the support frame 108. The bracket 116 includes a pair of flanges 124 and a base region 128, as shown in FIGS. 4 and 5. The flanges 124 may extend from the base region 128 at an angle approximately perpendicular to the base region 128. At least a portion of the first and second lock elements are coupled to the bracket 116. A top view of the bracket 116 is shown in FIG. 7.

Figure 6:
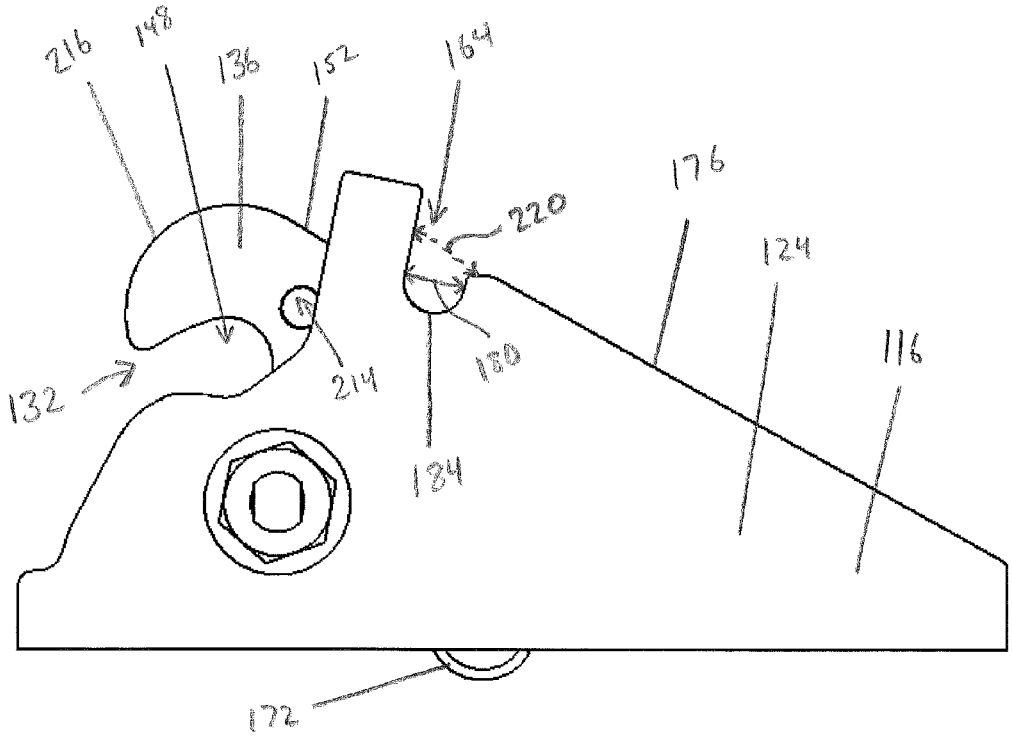
FIG. 6 is a side elevational view of the bracket assembly of the tabletop tilting mechanism of FIG. 1.
Figure 8:
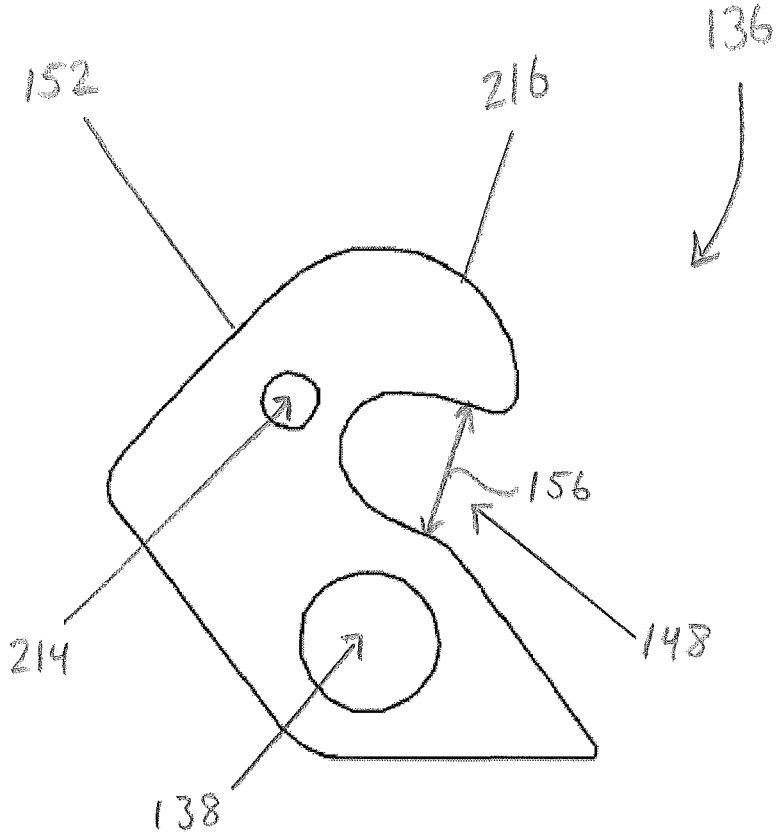
FIG. 8 is a side elevational view of a pivot member of the tabletop tilting mechanism of FIG. 1.

The first lock element, referred to as the hook lock 132 is shown in the disengaged position in FIG. 1 and in the engaged position in FIGS. 2 and 6. As illustrated, the hook lock 132 secures the tabletop 112 in the horizontal position; however, in other embodiments the hook lock 132 may secure the tabletop 112 in the vertical position. The hook lock 132 includes a pair of pivot members 136, ¬a first member referred to as a shaft 140, and two biasing springs 144. The pivot members 136 are pivotally coupled to an inside surface of a respective flange 124 through opening 138, as shown in FIG. 8. The pivot members 136 are configured to pivot between an engaged and a disengaged position. The biasing springs 144 are coupled to the pivot members 136 to bias the pivot members 136 toward the engaged position, as shown in FIG. 4. The shaft 140 is rigidly coupled to the support frame 108 a fixed distance from the support frame 108. Although the illustrated shaft 140 extends across the width of the bracket 116, other embodiments of the shaft 140 may include two distinct shaft sections, with each shaft section being separately coupled to the support frame 108. The hook lock 132, as illustrated, is configured to engage either embodiment of the shaft 140 when the tabletop 112 is in the horizontal position.

As illustrated in FIG. 8, each pivot member 136 includes a hook 148, an upper surface 216, and a contact surface 152. The hook 148 is the portion of the pivot member 136 that surrounds the shaft 140 to secure the shaft 140 to bracket 116, thereby securing the tabletop 112 in the horizontal position. Each hook 148 defines a gap as represented by length 156 of FIG. 8. Length 156 is greater than a width of the portion of the shaft 140 surrounded by the hook 148 to permit the shaft 140 to become fully seated in the hook 148. The shaft 140 contacts the upper surface 216 of the pivot members 136 as the tabletop 112 enters the horizontal position. In particular, when the shaft 140 contacts the upper surfaces 216, the pivot members 136 are pivoted toward the disengaged position against the biasing force of the biasing springs 144, until the shaft 140 contacts the bracket 116, at which point the biasing springs 144 snap the pivot members 136 back to the engaged position to secure the shaft 140 to the bracket 116. The contact surface 152 of the pivot members 136 refers to a region of the pivot member 136 opposite the hook 148. The contact surface 152 disengages the second lock element as explained below.

The second lock element, referred to as the loop lock 160, is shown in the engaged position in FIG. 1 and in the disengaged position in FIG. 2. As illustrated, the loop lock 160 secures the tabletop 112 in the vertical position; however, in other embodiments the loop lock 160 may secure the tabletop 112 in the horizontal position. The loop lock 160 includes a pair of notches 164, a second member referred to as a loop 168, and a biasing spring 172. The notches 164 are formed in the flanges 124 at the end of an inclined surface 176. The loop 168 is pivotally coupled to the support frame 108. Although referred to as a "loop", the loop 168 need not be a closed element; instead, the loop 168 may be a pair of elements pivotally connected to the support frame 108 and capable of engaging the notches 164. The notches 164 have a width represented by length 180 in FIG. 6, which is greater than a width of the portion of the loop 168 configured to be engaged by the notch 164. Additionally, the notches 164 may have a curved bottom region 184 that approximately matches the curvature of the portion of the loop 168 configured to be engaged by the notch 164. The loop lock 160 maintains the tabletop 112 in a vertical position by securing a portion of the loop 168 within the notches 164. Specifically, in the vertical position the notches 164 partially surround the loop 168; thereby coupling the loop 168 to the bracket 116 and also preventing the loop 168 from exiting the notches 164 until the actuator 188 disengages the loop lock 160.

The tabletop mechanism 104 includes an actuator 188 to disengage the currently engaged lock element 132, 160, thereby enabling the tabletop 112 to be transitioned between the horizontal and vertical positions. The actuator 188 is movable between an engaged and a disengaged position. The actuator 188 includes a handle 192, a coupling plate 196, and a coupling rod 200. The handle 192 is connected to the coupling plate 196 and the coupling plate 196 is connected to the coupling rod 200. As shown in FIGS. 1-3, the handle 192 and the coupling plate 196 are connected to the bottom surface of the tabletop 112. In other embodiments the handle 192 and coupling plate 196 may be connected to the support frame 108. As explained below, motion of the actuator 188 pivots the pivot members 136, causing one of the lock elements 132, 160 to become disengaged.

The handle 192 is slidingly connected to the bottom surface of the tabletop 112. As shown in FIGS. 1-3, fastening members 208 connect the handle 192 to the tabletop 112 through numerous elongated slots 204. The handle 192 may be slid between an engaged and a disengaged position by moving handle 192 axially a distance equal to the length of the slots 204.

Figure 9:
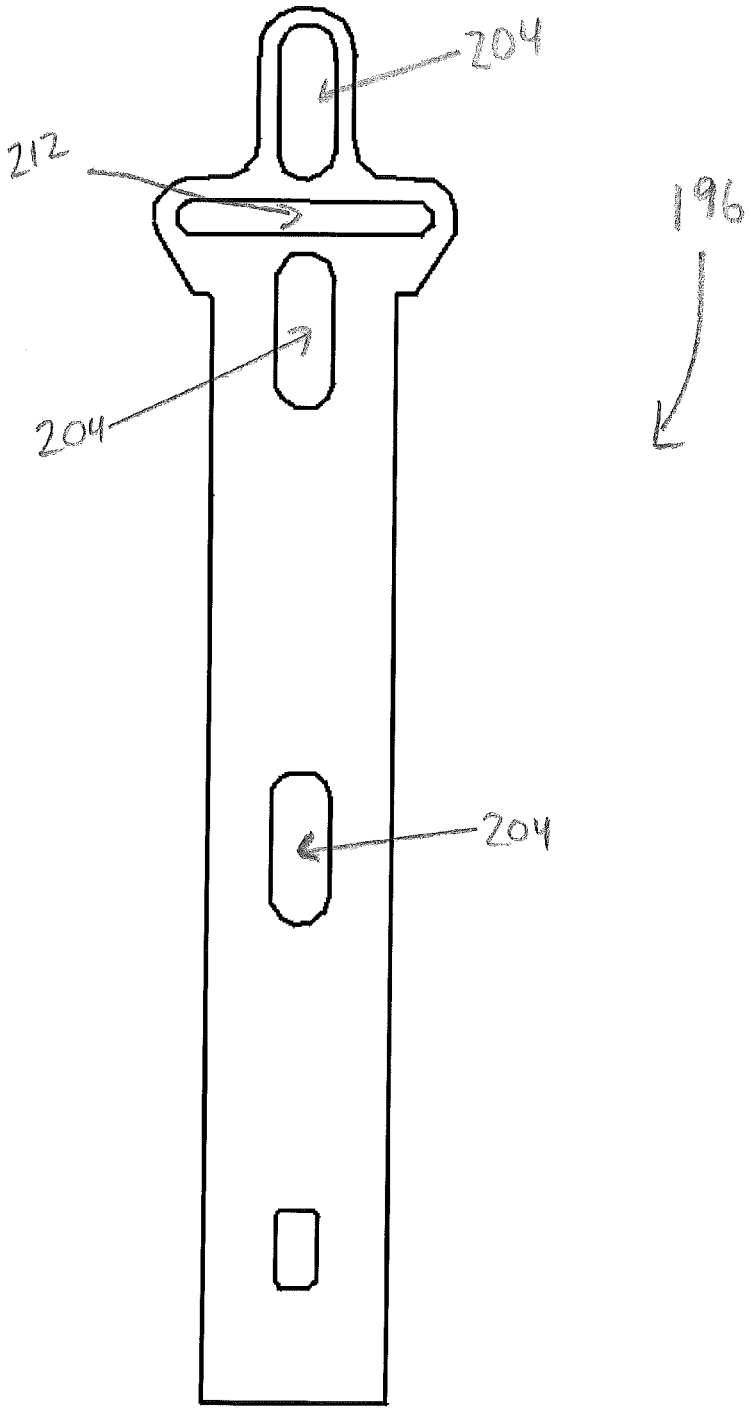
FIG. 9 is a top plan view of a portion of a coupling member of the tabletop tilting mechanism of FIG. 1.

The coupling plate 196 is illustrated in a pre-formed stage in FIG. 9. Once formed, fastening members 208 connect the coupling plate 196 to the tabletop 112 through numerous elongated slots 204. As the handle 192 is slid along the tabletop 112, the coupling plate 196 slides an equal axial distance.

The coupling rod 200 transfers the axial motion of the handle 192 and coupling plate 196 to the pivot members 136. The coupling rod 200 is pivotally coupled to the coupling plate 196 and opening 214 of the pivot members 136. A force may be exerted upon the handle 192 that causes the coupling rod 200 to pivot the pivot members 136 to the disengaged position. When the force upon the handle 192 is removed, the biasing members 144 pivot the pivot members 136 and the handle 192 back to the engaged position.

In operation, the tabletop mechanism 104 secures a tabletop 112 in either a horizontal or a vertical position. To secure the tabletop 112 in the vertical position of FIG. 1 from the horizontal position of FIG. 2, a user may slide the actuator 188 to the disengaged position to pivot the pivot members 136 to the disengaged position. When the pivot members 136 enter the disengaged position the hooks 148 no longer couple the shaft 140 to the bracket 116, permitting the tabletop 112 to be pivoted about pivot point 120 to the vertical position. During the transition of the tabletop 112 between the vertical and horizontal positions neither the hook lock 132 nor the loop lock 160 are engaged.

Once the tabletop 112 is pivoted to the vertical position the loop lock 160 becomes engaged to secure the tabletop 112 in the vertical position. Specifically, as the tabletop 112 is pivoted toward the vertical position the loop 168 slides along the inclined surfaces 176 toward the notches 164. When the tabletop 112 reaches the vertical position, biasing spring 172 pulls the loop 168 into the notches 164 to secure the tabletop 112 in the vertical position. In the vertical position, the tiltable table 100 may be moved and stored without the tabletop 112 pivoting relative to the support frame 108.

To secure the tabletop 112 in the horizontal position of FIG. 2 from the vertical position of FIG. 1 the handle 192 of the actuator 188 should be moved to the disengaged position, which pivots the pivot members 136 to the disengaged position. The pivotal motion of the pivot members 136 forces the contact surfaces 152 into contact with the loop 168, thereby lifting the loop 168 from the notches 164. In particular, the contact surfaces 152 gradually fill the notches 164 until the contact surfaces 152 reach a maximum height as shown by line 220 of FIG. 6. Once the loop 168 has been lifted from the notches 164, the tabletop 112 may be pivoted to the horizontal position. When the actuator 188 is released the biasing members 144 pivot the pivot members 136 back to the engaged position. As the tabletop 112 approaches the horizontal position the shaft 140 abuts the upper surface 216 of the pivot members 136 causing the pivot members 136 to pivot slightly in the direction of the disengaged position. Further tilting of the tabletop 112 toward the horizontal position causes the shaft 140 to contact the bracket 116 and become seated in the hooks 148, thereby enabling the biasing springs 144 to pivot the pivot members 136 back to the engaged position and secure the tabletop 112 in the horizontal position.

What is claimed is:

1. An article of furniture comprising:

a table top having an underside;

at least one leg rotatably coupled to the underside, the at least one leg having a locking bar;

at least one locking mechanism rotatably coupled to the underside, the locking mechanism including a hook configured to engage the locking bar, and the locking mechanism configured to rotate the hook into and out of an engaging position in which the hook engages the locking bar; and an actuator coupled to the at least one locking mechanism and coupled to the underside to slide longitudinally along the underside to rotate the hook into and out of the engaging position, wherein the actuator includes:

a plate slidably coupled to and configured to slide longitudinally along the underside;

a hand grip coupled to the plate and slidably coupled to the underside, the hand grip configured to enable a user to pull the actuator to slide the plate longitudinally along the underside; and a rod rotatably coupled to the plate and rotatably coupled to the at least one locking mechanism, the rod configured to rotate the at least one locking mechanism when the user pulls the actuator and slides the plate longitudinally along the underside.

2. The article of furniture of claim 1, wherein:

the underside of the table top is substantially planar;

the plate is substantially planar and is substantially parallel to the underside; and the rod is arranged at an angle relative to the underside and relative to the plate.

3. The article of furniture of claim 1, further comprising a biasing mechanism coupled to the at least one locking mechanism and configured to bias the at least one locking mechanism into the engaging position.

4. The article of furniture of claim 1, wherein the hand grip is sized so as to enable a user to grip the hand grip to pull the actuator with one hand.

5. The article of furniture of claim 1, further comprising fastening members configured to fasten the plate to the underside.

6. The article of furniture of claim 5, wherein the plate includes slots configured such that the fastening members are inserted through the slots to couple the plate to the underside.

7. The article of furniture of claim 6, wherein the slots have a length and the plate is slidable over a distance equal to the length of the slots.

8. The article of furniture of claim 7, wherein the rod is movable over a distance equal to the length of the slots.

* * * * *